US011498336B2

(12) United States Patent
Stefani

(10) Patent No.: US 11,498,336 B2
(45) Date of Patent: Nov. 15, 2022

(54) CLEANING DEVICE FOR PRINTING HEADS

(71) Applicant: SYSTEM CERAMICS S.P.A., Fiorano Modenese (IT)

(72) Inventor: Franco Stefani, Sassuolo (IT)

(73) Assignee: SYSTEM CERAMICS S.P.A., Fiorano Modenese (IT)

( * ) Notice: Subject to any disclaimer, the term of this patent is extended or adjusted under 35 U.S.C. 154(b) by 0 days.

(21) Appl. No.: 17/270,385

(22) PCT Filed: Sep. 4, 2019

(86) PCT No.: PCT/IB2019/057437

§ 371 (c)(1),
(2) Date: Feb. 22, 2021

(87) PCT Pub. No.: WO2020/058792

PCT Pub. Date: Mar. 26, 2020

(65) Prior Publication Data

US 2021/0197568 A1 Jul. 1, 2021

(30) Foreign Application Priority Data

Sep. 21, 2018 (IT) ..... 102018000008818

(51) Int. Cl.
*B41J 2/165* (2006.01)

(52) U.S. Cl.
CPC ..... *B41J 2/16517* (2013.01)

(58) Field of Classification Search
CPC ..... B41J 2/16517; B41J 2002/1657; B41J 2/1714; B41J 2/16505; B41J 2/16508; B41J 2/16511; B41J 2/16538; B41J 2/16544; B41J 2/16547; B41J 2/16585
See application file for complete search history.

(56) References Cited

U.S. PATENT DOCUMENTS

| | | | |
|---|---|---|---|
| 5,644,346 | A | 7/1997 | Schwiebert et al. |
| 5,757,399 | A | 5/1998 | Murayama et al. |
| 5,984,450 | A | 11/1999 | Becker et al. |
| 6,260,944 | B1 | 7/2001 | Mochizuki et al. |
| 6,478,402 | B1 | 11/2002 | Greive |
| 9,321,271 | B2 | 4/2016 | Kanda et al. |
| 2012/0206522 | A1 | 8/2012 | Kanda et al. |
| 2012/0212542 | A1 | 8/2012 | Kumura |
| 2018/0229504 | A1 | 8/2018 | Fukunaga et al. |

FOREIGN PATENT DOCUMENTS

| | | | |
|---|---|---|---|
| CN | 1931583 | A | 3/2007 |
| CN | 211918094 | U * | 11/2020 |
| EP | 2949470 | | 12/2015 |

(Continued)

*Primary Examiner* — Sharon Polk
(74) *Attorney, Agent, or Firm* — Pearne & Gordon LLP

(57) ABSTRACT

A cleaning device for printing heads arranged in a group along an alignment direction (Y) with a lower surface lying on a main plane (T). The device comprises a collecting head (2), movable along the alignment direction (Y) on the main plane (Y), in contact with or near the lower surfaces of the heads. The print head (2) is movable between a first and a second position that are located at the ends of the group of heads. The collecting head (2) is provided with an inlet opening (21) for collecting material from the heads (T).

12 Claims, 7 Drawing Sheets

(56) References Cited

FOREIGN PATENT DOCUMENTS

| | | | | |
|---|---|---|---|---|
| EP | 3705297 | A1 * | 9/2020 | ..... B41J 2/16505 |
| JP | 2012005948 | | 1/2012 | |
| KR | 20060013062 | A | 2/2006 | |
| WO | 2006060841 | A1 | 6/2006 | |
| WO | 2008136207 | A1 | 11/2008 | |
| WO | 2017199601 | | 11/2017 | |

* cited by examiner

CLEANING DEVICE FOR PRINTING HEADS

The present invention relates to a device for the protection, collection and cleaning of printing heads.

In particular, it relates to a device for the protection, colour collection and cleaning of ink jet printing heads, arranged in groups along a print bar.

Decorating machines are currently available for the ink jet printing of ceramic tiles that comprise a certain number of heads, each of which has a plurality of nozzles for the emission of the decorative enamel.

The heads are arranged so that the various nozzles substantially lie on the same horizontal plane, placed above the tiles to be decorated. Furthermore, the heads are subdivided between different print bars, each of which is dedicated to a specific colour. The print head of the machine therefore comprises a prefixed number of print bars, each of which comprises a prefixed number of heads. The print bars can be slidable between a printing position, i.e. a work position, a rest position and a maintenance position, in which they are external with respect to the print area in a position that is easy to access by the operators.

The inks used for decorating the ceramic tiles are substantially in the form of an aqueous suspension. During the printing process which, as is known, envisages the continuous transit of the tiles below the printing heads, a relatively humid atmosphere is created in the space comprised between the heads and the plane that transports the tiles in advancement. The humidity tends to condense in contact with the printing heads, forming drops that have to be removed relatively frequently. In any case, it is periodically necessary to thoroughly clean the surface of the heads.

Current printing machines are provided with very complex and bulky cleaning machines.

Some of the current cleaning systems comprise rather bulky collecting tanks necessary for removing the liquid that exits from the printing heads during the purging and cleaning procedure on the printing heads. Such tanks are located at the front or back of the printing head of the machine, notably increasing the longitudinal dimension thereof, i.e. the dimension along the advancement direction of the tiles.

Other cleaning systems comprise a plurality of devices each of which is dedicated to the cleaning of a print bar. Each device is interposed between two adjacent print bars. Also in this solution, the longitudinal dimension of the printing head is notably increased. Furthermore, the distance between the print bars is also greater, therefore there is a higher possibility of errors in the relative positioning between the print bars.

The aim of the present invention is to offer a device for collecting and cleaning printing heads that makes it possible to overcome the drawbacks of currently available cleaning systems.

An advantage of the collecting and cleaning device according to the present invention is that it does not modify the longitudinal dimension of the printing head.

Another advantage of the collecting and cleaning device according to the present invention is that it does not require the modification of the overall architecture of the printing head, and in particular does not require the increase in mutual distance between print bars.

Further characteristics and advantages of the present invention will become more apparent in the following detailed description of an embodiment of the present invention, illustrated by way of non-limiting example in the attached figures, wherein.

Figure 4A:
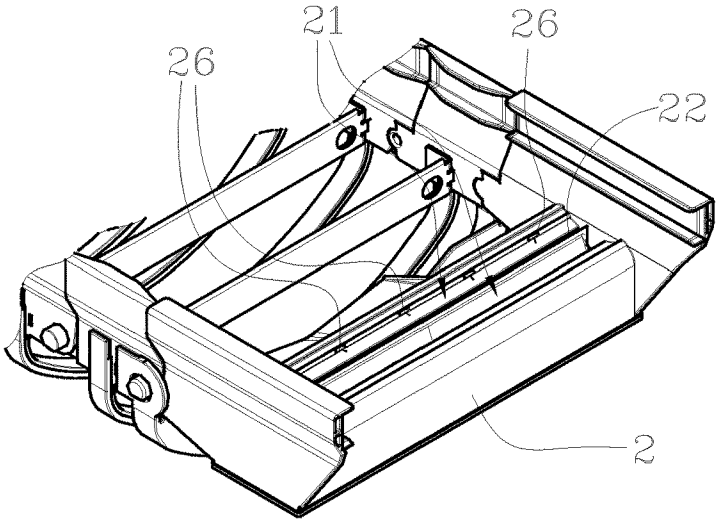
FIG. 4 shows an isometric view of a component of the device, in a first possible embodiment.
Figure 4:
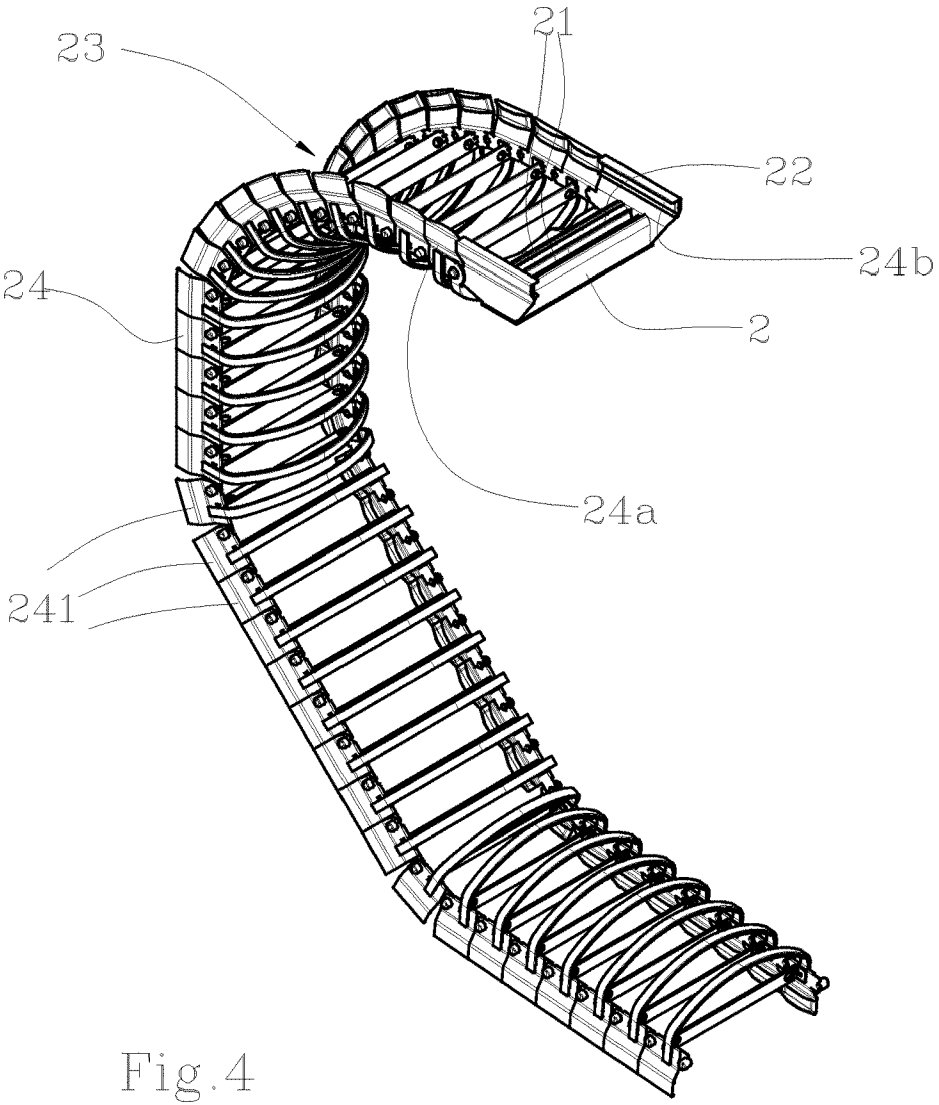
Figure 6:
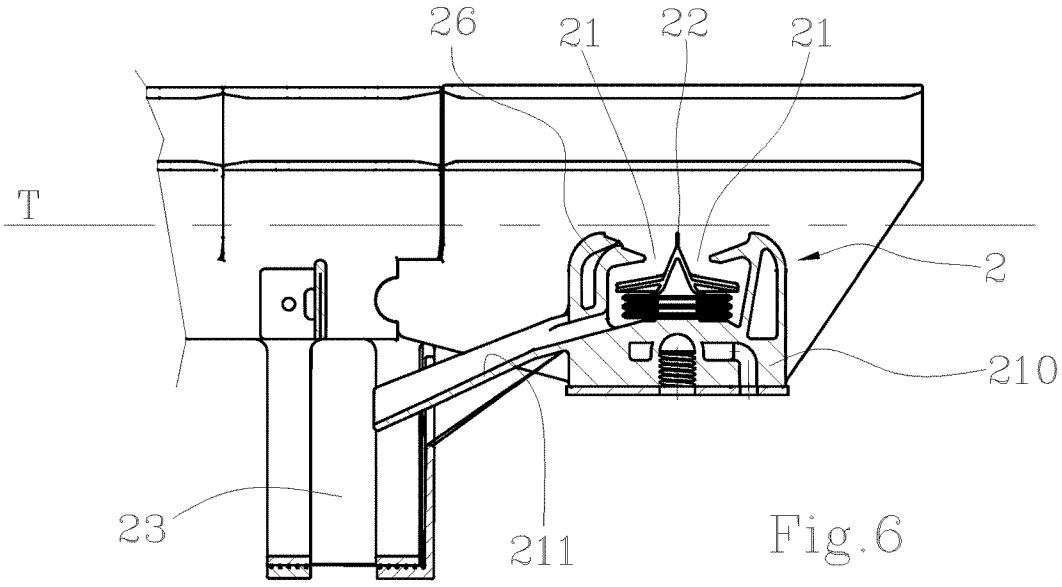
Figure 6A:
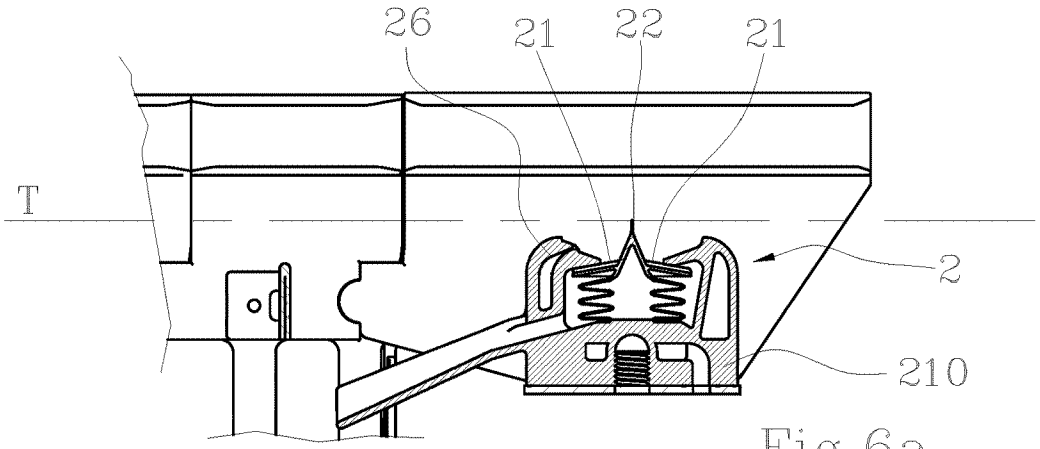
Figure 5:
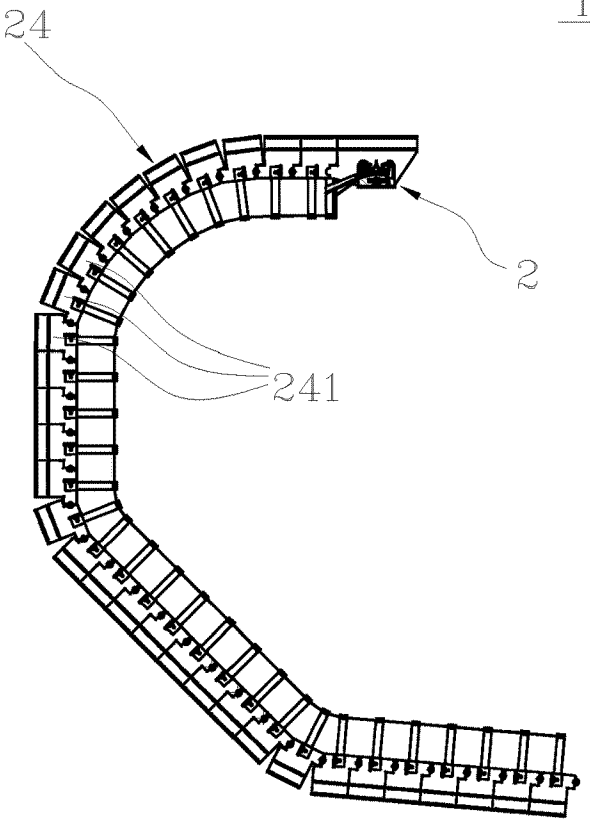
Figure 7:
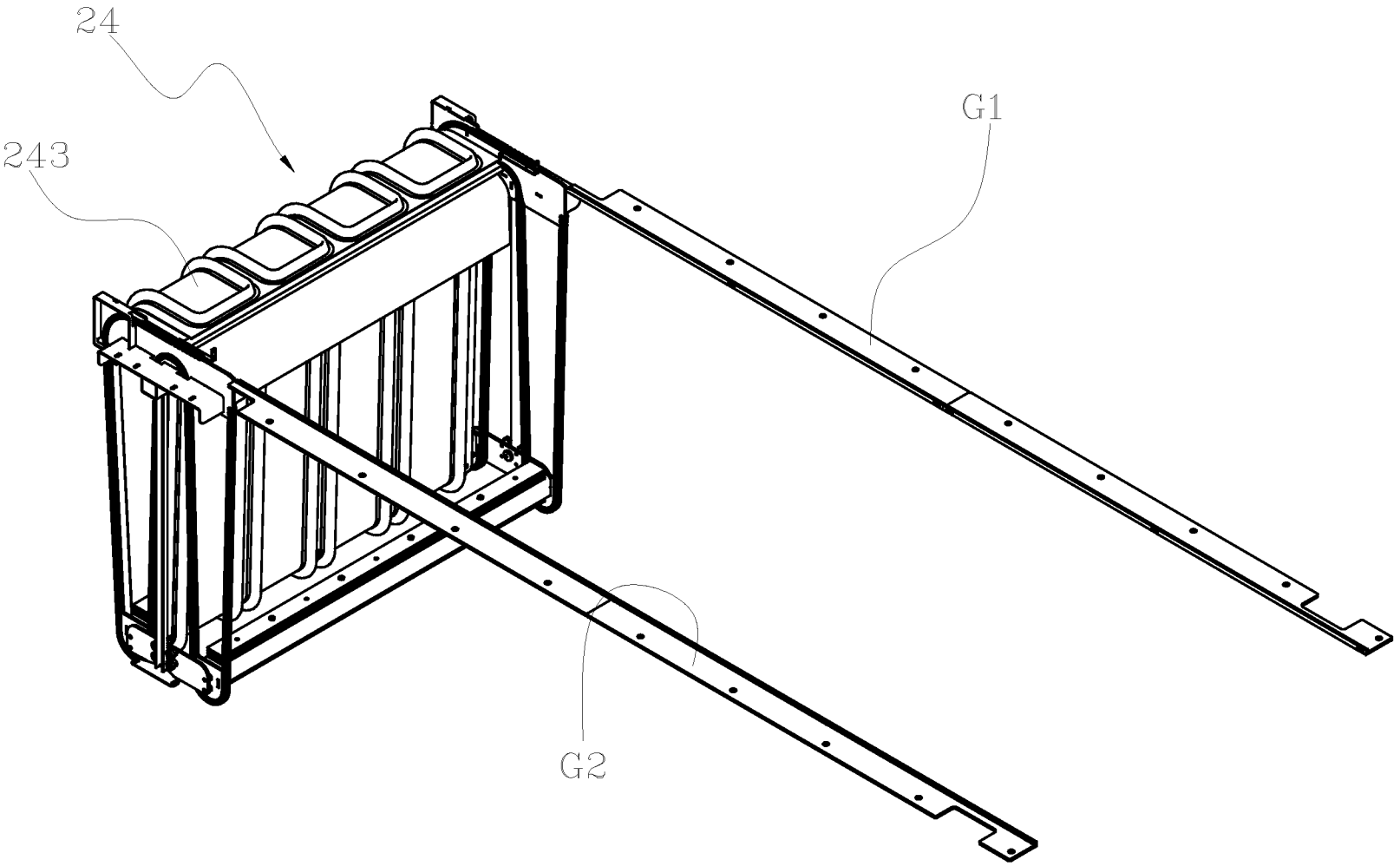
Figure 8:
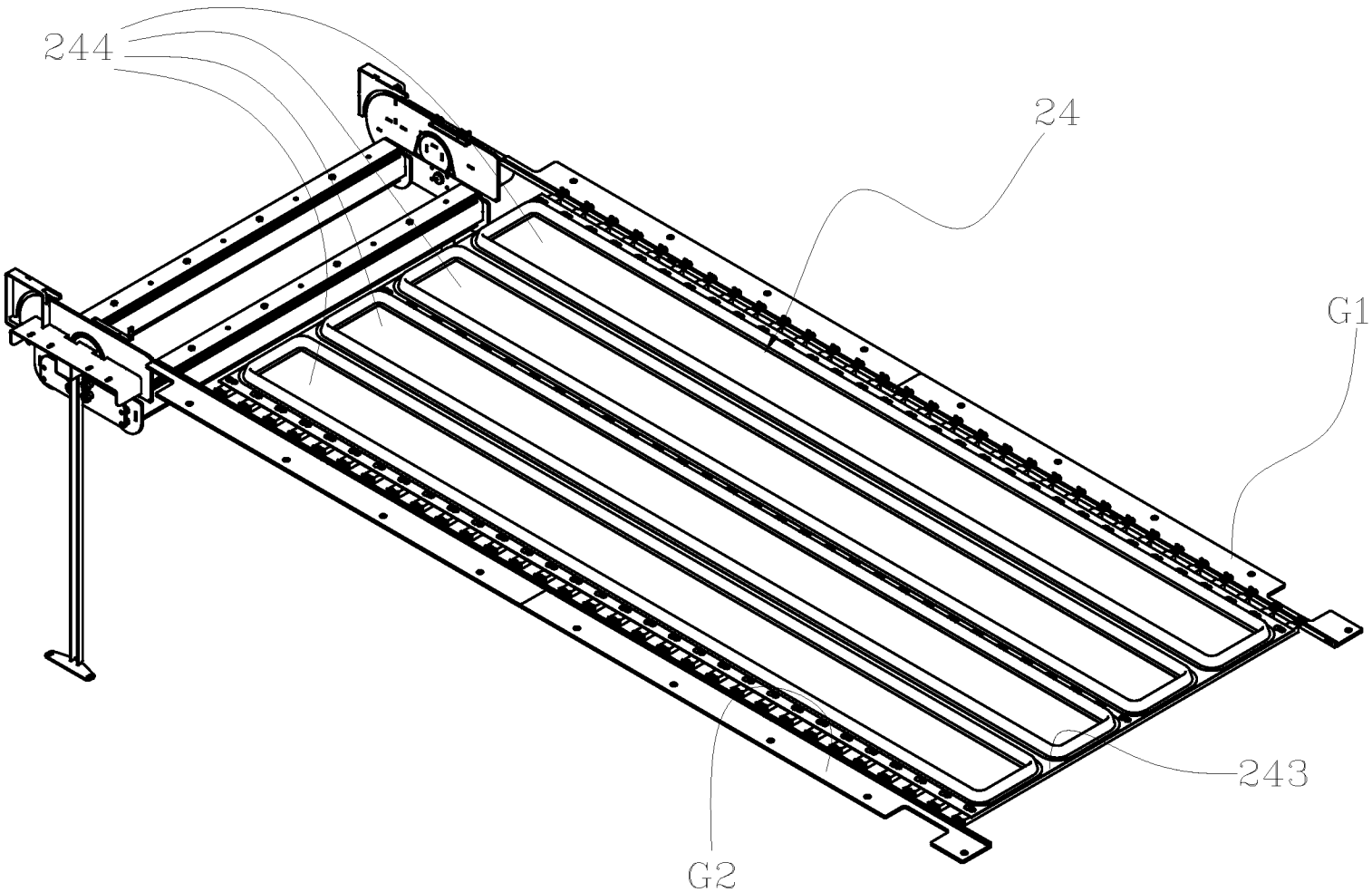

FIG. 4*a* shows an enlarged zone of FIG. 4;

FIG. 5 shows a sectional view, taken on a middle plane, of the component of FIG. 5;

FIGS. 6 and 6*a* show two enlarged views of a zone of FIG. 5;

FIG. 7 shows an isometric view of a component of the cleaning device, in a second possible embodiment;

FIG. 8 shows the component of FIG. 7 in a second operating position.

The cleaning device according to the present invention is particularly advantageous for performing the cleaning of printing heads, e.g. ink-jet, arranged in a group along a substantially horizontal alignment direction (Y), with a lower surface lying on a main plane (T).

Each head comprises a plurality of emitting nozzles that lie on the main plane (T). The lower surfaces of the heads are coplanar to each other and lie on the main plane (T).

A group of heads substantially defines a print bar (PB). The heads of a print bar (PB) are powered by a plurality of circuits and hydraulic devices known in the sector, typically closed inside a casing above the main plane (T).

The heads face downwards to emit the decorating liquid downwards. The objects to decorate, e.g. ceramic tiles, are located below the heads and the print bar (PB).

Two or more print bars (PB) of the type described above may be provided in the printing head of a decorating machine. The print bars (PB) are alongside one another parallel to the alignment direction (Y). The lower surfaces of the heads of the print bars (PB) are coplanar to one another and lie on the same main plane (T), located above a transport plane intended to bring the objects to be decorated in advancement. The advancement direction of the transport plane is substantially horizontal and perpendicular to the alignment direction (Y).

The collecting and cleaning device according to the present invention comprises a collecting head (2), movable along the alignment direction (Y) on the main plane (T). In substance, the collecting head (2) is movable in contact with or near the lower surfaces of the heads.

The collecting head (2) is movable along the alignment direction (Y) between a first and a second position. Such first and second position are preferably located at the ends of the group of heads, i.e. at the ends of the print bar (PB). In other words, the first and the second position are at opposite ends of the print bar (PB), so that the collecting head (2) can interact with the lower surface of each head belonging to the print bar (PB).

Figure 1:
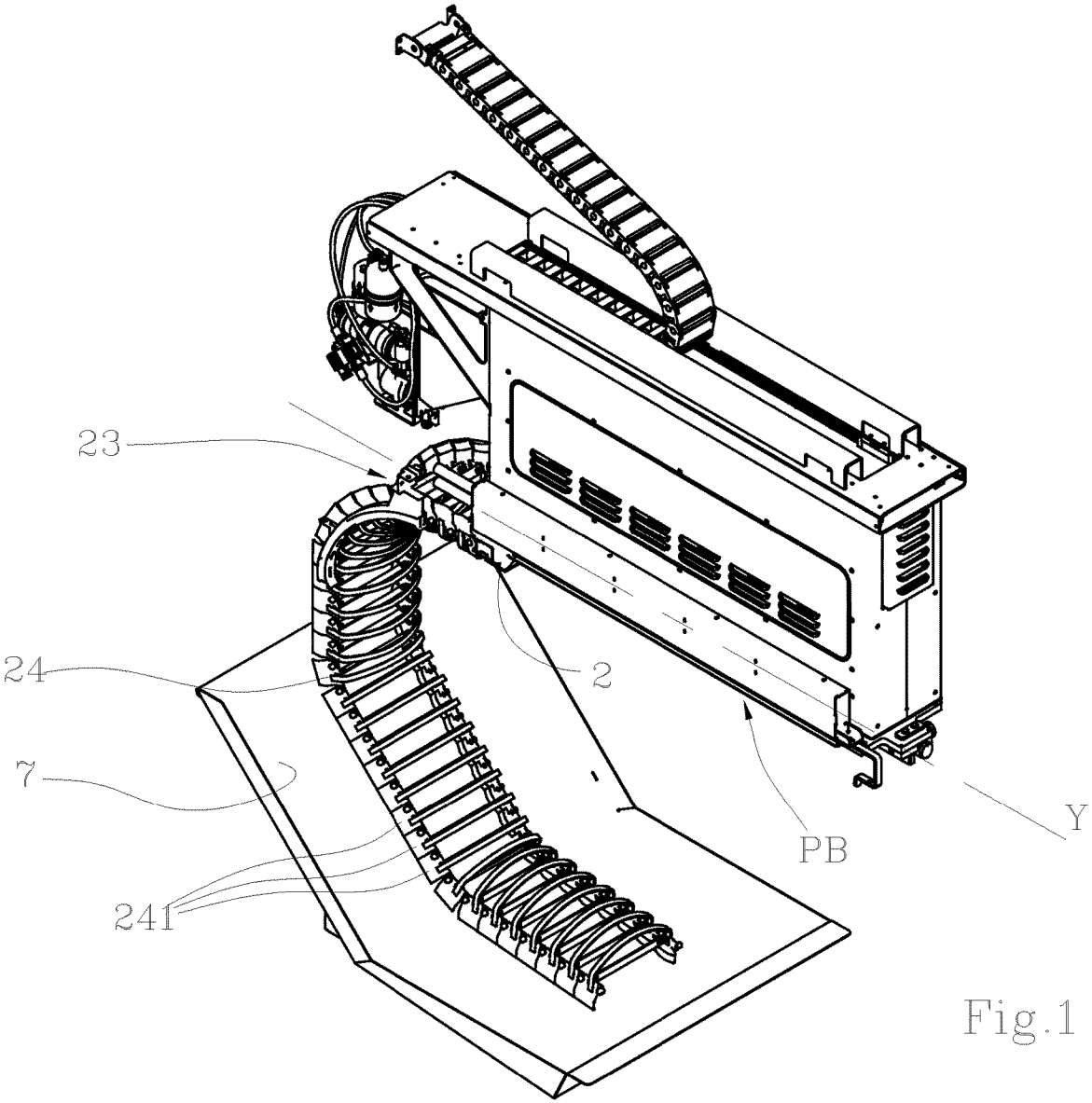
FIG. 1 shows a schematic isometric view of the cleaning device according to the present invention.
Figure 2:
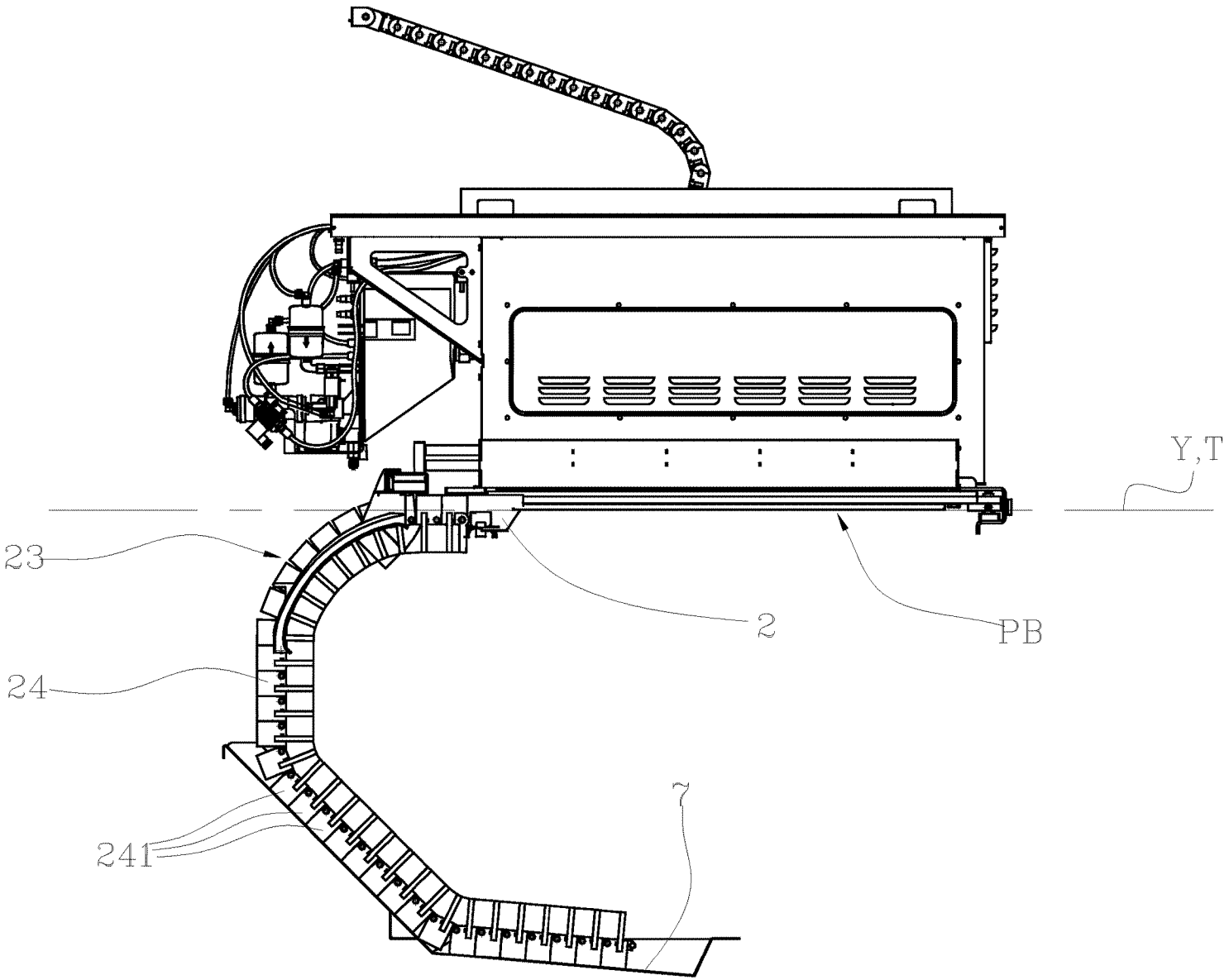
FIGS. 2 and 3 show two lateral views in two different operating positions of the cleaning device according to the present invention.

In the first position, illustrated in FIG. 2, the collecting head (2) is at an internal end of the print bar (PB), i.e. from the side of the print bar (PB) facing towards the decorating machine. The collecting head (2) does not interfere with any head, and neither is it placed in front any head. It is therefore a rest position of the collecting head (2), in which the print bar (PB) can perform normal printing operations.

The collecting head (2) is located and is movable below the heads, to come into contact with or to lap the lower surfaces of the heads themselves. In other words, the collecting head (2) is arranged in the space comprised between the main lying plane (T) of the lower surfaces of the heads and the transport plane of the objects to be decorated. The collecting head (2) therefore does not require the bulky lateral space with respect to the print bar (PB), but remains within the plan dimensions of the print bar (PB).

As can be seen in FIG. 4, the collecting head (2) is provided with an inlet opening (21) for collecting material from the heads. The inlet opening (21) is turned upwards.

A doctor blade (22) is located near the inlet opening (21). Such doctor blade (22) is structured to slide on the main plane (T), i.e. in contact with the lower surface of the heads. During the movement of the collecting head (2), the doctor blade (22) slides on the main plane (T), removing the material accumulated on the lower surface of the heads. The material removed runs along the doctor blade (22) and enters into the inlet opening (21).

Preferably, the doctor blade (22) is located in an intermediate position to the inlet opening (21). In this way, the doctor blade (22) leads the material removed by the heads into the inlet opening (21) in both sliding directions of the collecting head (2). For example, in the embodiment that can be seen in FIGS. 3 and 4, the doctor blade (22) is located inside the inlet opening (21), projecting upwards and towards the main plane (T).

In the embodiment represented, the collecting head (2) comprises a concave body (210), whose concavity faces upwards. The doctor blade (22) is associated with the concave body (210) so as to project through the inlet opening (21). The inlet opening (21) opens onto the concave body (210), so that the material scraped by the doctor blade (22) is collected in the concave body (210).

Preferably, the doctor blade (22) is associated with an actuator that allows the doctor blade (22) to assume an extended configuration, in which it can come into contact with the lower surface of the heads, and a contracted configuration, in which it remains distanced from the lower surface of the tiles. In the embodiment represented, the doctor blade (22) is associated with a bellows body (22*a*), provided to assume an extended configuration (FIG. 6*a*) and a contracted configuration (FIG. 6). In the extended configuration, the doctor blade (22) projects beyond the opening (21), to come into contact with the lower surface of the heads. In the contracted configuration, the doctor blade (22) does not project from the opening (21) and is not able to come into contact with the lower surface of the heads. In the extended configuration of the bellows body (22*a*) the doctor blade is substantially in an active condition, in which it can scrape the material from the heads. In the contracted configuration of the bellows body (22*a*) the doctor blade (22) is instead in an inactive condition, i.e. it does not come into contact with the heads. By acting on the bellows body (22*a*) it is therefore possible to control the action of the doctor blade (22). The activation of the bellows body (22*a*) can be performed, for example, by supplying compressed air to the bellows body (22*a*) in a controlled manner, through a circuit known to a person skilled in the art.

A motor means, not illustrated in detail since it is accessible to a person skilled in the art, is arranged to activate the collecting head (2) to slide along the alignment direction (Y).

The operation of the device for performing a cleaning cycle takes place in the following ways.

The collecting head (2) is initially in the rest condition in the first position. Starting from the first position, the collecting head (2) moves towards the second position. During the movement of the collecting head (2), the doctor blade (22) translates on the main plane (T), sliding in contact with the lower surface of the heads. The residues of enamel that are on the lower surface of the heads are scraped by the doctor blade (22) and, running along the blade (22), enter into the inlet opening (21) and from the latter pass to a collecting conduit (23). The doctor blade (22) is active both in the forward stroke from the first towards the second position, and in a return stroke from the second position towards the first position. This is because the doctor blade (22) is located within the profile of the inlet opening (21), therefore the material collected by the doctor blade (22) is led into the inlet opening (21) in both the strokes of the collecting head (2).

The cleaning cycle can be activated at prefixed moments without requiring any particular interventions on the printing machine. Apart from the obvious interruption of the printing operations, the printing machine does not need to be modified in any way. Very simply, the collecting head (2) initiates its movements between the first and the second position, also for various subsequent steps, in a totally independent manner. Furthermore, as already underlined, the collecting head (2) remains within the dimensions of the print bar (PB).

Advantageously, the collecting head (2) can be provided with one or more nozzles for emitting a cleaning liquid, water and/or other substances. The cleaning liquid can be sent onto the lower surfaces of the heads, to promote the detachment of residues of material and to promote the sliding of the doctor blade (22). The nozzle or nozzles can be powered with a circuit known to a person skilled in the art.

The collecting head (2) comprises a collecting conduit (23), connected to the inlet opening (21), to collect the material removed from the heads. In the solution shown, the collecting conduit (23) is connected to the concave body (210) onto which the inlet opening (21) faces. Preferably, the concave body (210) is connected to the collecting conduit (23) by means of a fitting (211).

The collecting conduit (23) comprises a deformable body (24) which modifies its configuration following the movement of the collecting head (2) between the first and the second position. The deformable body (24) has a concave and open conformation, i.e. delimited by a concave and open non-tubular surface. At least in the second position of the collecting head (2), the concavity of the deformable body (24) faces upwards, at least in a section of the deformable body placed opposite the heads of the print bar (PB).

In the first position of the printing head (2), the deformable body (24) is collected to the side of the print bar (PB) or, in any case, is not placed in front of any head of the print bar (PB) so that the print bar (PB) can freely perform the normal printing operations. This represents a great advantage of the device according to the present invention with respect to the devices currently known.

In fact, thanks to the characteristics of the deformable body (24), the collecting conduit (23) can assume a rest configuration (corresponding to the first position of the collecting head (2)) in which it does not interfere with the heads of the print bar (PB), and in which it is arranged to the side of the print bar (PB), however remaining aligned with the latter along the alignment direction (Y). Therefore, the collecting conduit (23) does not require any bulky space projecting with respect to the print bar (PB) in the perpendicular and coplanar direction to the alignment direction (Y). This means that the print bar (PB) may be alongside another two print bars (PB) placed at a shorter distance, i.e. at the same distance at which they are located in a current decorating machine.

When the collecting head (2) is in the first position, the deformable body (24) is arranged so as to promote discharge by gravity of the material collected by the heads.

In a possible embodiment, illustrated in FIGS. 1, 4, 7 and 8, the deformable body (24) is preferably structured to remain between two vertical planes parallel to the alignment direction (Y) remaining within the dimensions of the print bar (PB).

In this embodiment, the deformable body is slidable along an arched path. In the second position of the collecting head (2), shown in FIG. 3, the deformable body (24) has at least one rectilinear section located below the main plane (T) and the heads. In such rectilinear section the concavity of the deformable body faces upwards, to promote the collection of the material removed by the heads. In the first position of the collecting head (2), shown in FIG. 2, at least one portion of the deformable body (24) turns the concavity downwards, to promote the outflow of the collected material. A collecting slide (7) can be arranged near the deformable body (24) to collect the material that flows out from the latter. Furthermore, as already underlined, in the first position of the collecting head (2) the deformable body (24) is placed laterally to the print bar (PB), so as not to be placed between the heads and the objects to be decorated. In this embodiment, the deformable body (24) is arranged to the side of the end of the print bar (PB), and partially below the plane that supports the objects to be decorated.

The path followed by the deformable body is defined by guides engaged at side edges of the deformable body (24). Such guides are conformed according to the path that is intended to be given to the deformable body. The guides are not represented in detail as they are components known to a person skilled in the art. The deformable body (24) is drawn by the collecting head (2), i.e. it moves integrally with the collecting head (2), however following its own arched path.

Figure 3:
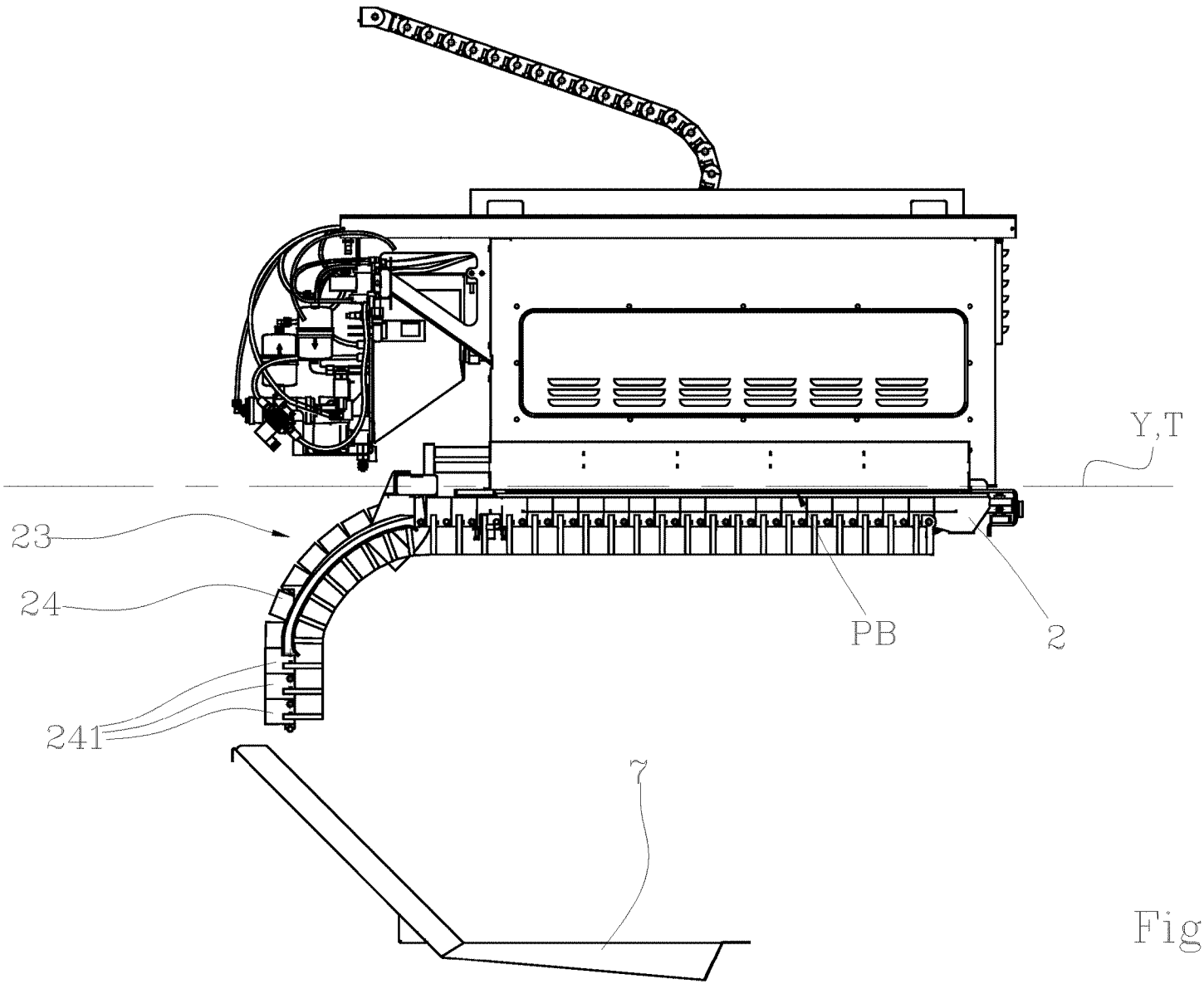

Preferably, but not necessarily, the deformable body (24) has two side flanks (24*a*, 24*b*) set up to close laterally the colour bar (PB) when the collecting head (2) is in the second position, as shown in FIG. 3.

Thanks to the presence of the side flanks (24*a*, 24*b*), the deformable body (24) can also be used to close and protect the heads of the print bar (PB). For example, in a decorating machine comprising various print bars (PB), a determined print bar (PB) can be deactivated and kept protected bringing the corresponding collecting head (2), together with the deformable body (24) to the second position.

In a possible embodiment, illustrated in FIGS. 3 and 4, the deformable body (24) comprises a plurality of segments (241), connected to each other consecutively at hinges rotating about axes that are perpendicular to the alignment direction (Y). Each segment (241) has a concave conformation for collecting the material coming from the inlet opening (21). In the embodiment shown, each segment is closed on the bottom by means of a waterproof and flexible element, in the form for example of a band that extends along the whole chain formed by the segments (241). The side flanks (24*a*, 24*b*) are defined by side portions of the segments (241).

In a second embodiment, illustrated in FIGS. 7 and 8, the deformable body (24) comprises a flexible mat (243), provided with one or more collecting channels (244). The collecting channels (244) are defined by a profile projecting from the flexible mat (243). A particularly effective material for creating a flexible mat comprises polyolefins.

Also in this embodiment, the deformable body is slidable along an arched path. The collecting channels (244) are turned towards the outside of the path. In the second position of the collecting head (2), shown in FIG. 8, the deformable body (24) has at least one rectilinear section located below the main plane (T) and the heads. The collecting channels (244) are turned towards the main plane (T). In the first position of the collecting head (2), illustrated in FIG. 7, at least one portion of the deformable body (24) turns a section of the collecting channels (244) downwards, to promote the outflow of the collected material. Furthermore, in the first position of the collecting head (2) the flexible mat (243) is collected to the side of an end of the print bar (PB), so as not to be placed between the heads and the objects to be decorated.

As can be seen in FIGS. 7 and 8, the flexible mat (243) is slidable along a path that has a rectilinear section, below the print bar (PB), and a curved section, adjacent to the rectilinear section. In the curved section of the path, the flexible mat (243) is folded or partially folded onto itself, with two sections oriented almost vertically, assuming a particularly compact configuration. In passing from the rectilinear section to the curved section, the flexible mat (243) is oriented vertically, promoting the outflow of the collected material downwards. A further collecting tank, not illustrated, can be positioned below the curved section of the path of the flexible mat (243), to collect the material that flows out from the mat (243) itself.

The path followed by the mat (243) is defined by guides (G1, G2) engaged at side edges of the flexible mat (243). Such guides have a rectilinear section (G1), arranged below the print bar (PB) and a curved section (G2), shaped in relation to a prefixed contracted configuration of the flexible mat (243). The guides (G2, G2) can be located near the main plane (T) or on the plane itself. The guides (G1, G2) are known to a person skilled in the art, therefore will not be described in further detail. The flexible mat (243) is drawn by the collecting head (2), i.e. it moves integrally with the collecting head (2), however following its own arched path.

The cleaning device according to the present invention can be replicated for a prefixed number of print bars (PB) present in a decorating machine. Typically, the print bars (PB) are alongside one another parallel to the alignment direction (Y). The lower surfaces of the heads of the print bars (PB) are coplanar to one another and lie on the same main plane (T), located above a transport plane intended to bring the objects to be decorated in advancement.

In such case, the device comprises two or more collecting heads (2) of the type described up to now. The collecting heads (2) are flanked to one another and movable along parallel directions to the alignment direction (Y). Each collecting head (2) is movable in contact with or near the main plane (T) of a print bar (PB). Each print head (2) is movable between a first and a second position that are located at the ends of the respective print bar (PB). The collecting heads (2) can be movable in a synchronised way, or independently from each other. In a possible embodiment, each collecting head (2) is provided with its own collecting conduit (23). The deformable element (24) of each collecting conduit (23), in the first position of the respective collecting head (2), is placed laterally to the print bar (PB), so as not to be interposed between the heads and the objects to be decorated. In the embodiment of FIGS. 3 and 4, the deformable body is arranged to the side of the end of the print bar (PB), and partially below the plane that supports the objects to be decorated. When the collecting heads (2) are all in the first position, all the print bars (PB) can perform the envisaged printing operations.

In the embodiment of FIGS. 7 and 8, the deformable body (24), provided with various collecting channels (244), can serve a corresponding number of print bars (PB). In the example represented, the deformable body (24), in the form of a flexible mat (243), comprises three collecting channels (244), and can serve three print bars (PB) alongside one another. In the first position of the collecting heads (2), illustrated in FIG. 7, at least one portion of the deformable body (24) turns a section of the collecting channels (244) downwards, to promote the outflow of the collected material. Furthermore, in the first position of the collecting head (2) the flexible mat (243) is collected to the side of an end of the print bar (PB), so as not to be placed between the heads and the objects to be decorated.

Thanks to the configuration of the printing device, it is not necessary to increase the distance that separates the print bars (PB) from each other. Each collecting head (2) is in fact located below the respective print bar (PB), and remains within the plan dimensions of the respective print bar (PB).

The invention claimed is:

1. A cleaning device for printing heads arranged in a group along an alignment direction (Y) with a lower surface lying on a main plane (T), comprising:

a movable collecting head (2) in contact with or near the lower surfaces of the printing heads along the alignment direction (Y) on the main plane (T), between a first and a second position;

a collecting conduit (23), connected to the collecting head (2), adapted to collect material removed from the printing heads;

wherein the collecting conduit (23) comprises a deformable body (24) that modifies its conformation by following the movement of the collecting head (2) between the first and the second position;

characterised in that:

the deformable body (24) has a concave and open conformation;

at least in the second position of the collecting head (2), the concavity of the deformable body (24) faces upwards, at least in one section of the deformable body placed opposite the printing heads of a print bar (PB).

2. The device according to claim 1, wherein, in the first position of the collecting head (2), the deformable body (24) is arranged to the side of the printing heads.

3. The device according to claim 1, wherein, in the first position of the collecting head (2), the deformable body (24) is arranged so as to promote discharge by gravity of material from the printing heads.

4. The device according to claim 1, wherein the deformable body (24) has two side flanks (24*a*, 24*b*) set up to close laterally the print bar (PB) when the collecting head (2) is in the second position.

5. The device according to claim 1, wherein the deformable body (24) comprises a plurality of segments (241), that are connected consecutively to one another at hinges rotating around axes that are perpendicular to the alignment direction (Y).

6. The device according to claim 1, wherein the deformable body (24) comprises a flexible mat (243), provided with one or more collection channels (244).

7. The device according to claim 1, wherein the collecting head (2) is provided with an inlet opening (21) for collecting material from the printing heads.

8. The device according to claim 7, wherein the collecting head (2) comprises a doctor blade (22), located near the inlet opening (21) and structured to translate on the main plane (T) in contact with the lower surface of the printing heads.

9. The device according to claim 8, wherein the doctor blade (22) is set up to adopt an extended configuration, in which it can come into contact with the lower surface of the printing heads, and a contracted configuration, in which it remains distanced from the lower surface of the printing heads.

10. The device according to claim 1, wherein the collecting head (2) comprises one or more nozzles for emitting a cleaning liquid onto the lower surfaces of the printing heads.

11. The device according to claim 1, comprising two or more collecting heads (2), which are alongside one another and movable along directions parallel to the alignment direction (Y), wherein each movable collecting head (2) is in contact with or near the main plane (T) and of the lower surfaces of the printing heads of a respective group, and wherein each collecting head (2) is movable between a first and a second position that are located at the ends of the respective group of printing heads.

12. A decorating machine, comprising two or more print bars (PB), each of which comprises a plurality of printing heads provided with a lower surface lying on a main plane (T), wherein the print bars (PB) are alongside one another parallel to a horizontal alignment direction (Y); a transport plane for objects to be decorated, movable along a horizontal and perpendicular direction to the alignment direction (Y); characterized in that it comprises two or more collecting heads (2) according to claim 1, which are alongside one another and movable along directions parallel to the alignment direction (Y), wherein each movable collecting head (2) is in contact with or near the main plane (T) and the lower surfaces of the printing heads of a respective print bar, and wherein each collecting head (2) is movable between a first and a second position that are located at the ends of the respective print bar.

* * * * *